United States Patent [19]

Daswick

[11] 4,439,937

[45] Apr. 3, 1984

[54] INTEGRALLY CAST SHOE SOLE CONTAINING STIFFENER MEMBER

[76] Inventor: Alexander C. Daswick, 700 Orange Grove #210, South Pasadena, Calif. 91030

[21] Appl. No.: 402,060

[22] Filed: Jul. 26, 1982

[51] Int. Cl.[3] ..... A43B 13/04; A43B 23/00

[52] U.S. Cl. ..... 36/107; 36/22 A; 36/32 R; 36/108; 36/72 A

[58] Field of Search ..... 36/28, 25 R, 22 A, 32 R, 36/72 A, 76 R, 102, 108, 91, 114, 129, 107

[56] References Cited

U.S. PATENT DOCUMENTS

| | | | |
|---|---|---|---|
| 3,936,956 | 2/1976 | Famozare, Jr. | 36/32 R |
| 4,041,619 | 8/1977 | Sapper | 36/25 R |
| 4,246,708 | 1/1981 | Glader | 36/107 |
| 4,262,433 | 4/1981 | Hagg et al. | 36/32 R |
| 4,348,821 | 9/1982 | Daswick | 36/30 R |

FOREIGN PATENT DOCUMENTS

| | | | |
|---|---|---|---|
| 1221716 | 6/1960 | France | 36/32 R |
| 556310 | 2/1957 | Italy | 36/76 |
| 1075212 | 7/1967 | United Kingdom | 36/108 |

*Primary Examiner*—Louis Rimrodt
*Assistant Examiner*—Steven N. Meyers
*Attorney, Agent, or Firm*—Gene W. Arant

[57] ABSTRACT

A shoe sole structure in which a metallic stiffener member having generally the form of an elongated plate is encapsulated within a solid body of elastomeric material. The elastomeric material provides a ground-engaging surface underneath the stiffener member, a foot-supporting surface above the stiffener member, and also provides a toe-supporting portion which extends forwardly of the stiffener member and is free to flex vertically as needed.

11 Claims, 5 Drawing Figures

INTEGRALLY CAST SHOE SOLE CONTAINING STIFFENER MEMBER

RELATED APPLICATION

The invention disclosed in the present application is an improvement over that disclosed in my copending application Ser. No. 155,589 filed June 2, 1982, now U.S. Pat. No. 4,348,821.

BACKGROUND OF THE INVENTION

In recent years there have been many innovations relating to shoes, some of which are of decorative or appearance value only, while others relate to the mechanical or utilitarian qualities of the product. The invention disclosed in my above-referenced patent is in the latter category.

In the manufacture of any product, cost is always an important consideration. Shoes are no exception. Thus it is advantageous to construct a shoe sole in such a way that it will provide superior performance, but yet its manufacturing cost is reduced.

The object of the present invention, therefore, is to provide a shoe sole structure which is of superior quality, but yet lends itself to manufacturing by machine methods at low cost.

SUMMARY OF THE INVENTION

According to the present invention a shoe sole structure is made from a solid mass of elastomeric material within which a metallic stiffener member is imbedded. More specifically, the stiffener member has generally the form of a flat plate which is of sufficient length to extend from the heel portion of the shoe to the metatarsal arch region, and has a plurality of holes or perforations formed therein.

Thus, the solid mass of elastomeric material includes one portion which lies beneath the stiffener member for engaging the ground, and another portion which lies above the stiffener member for supporting the foot of the wearer. The elastomeric material is cast as a solid body extending through the holes or perforations in the stiffener member, so that its upper and lower portions are adequately secured together.

Further, in accordance with the invention, the same mass of elastomeric material extends forwardly from the forward extremity of the stiffener member, so as to provide a toe-supporting portion of the shoe sole structure. Thus the stiffener member performs the traditional function of an arch support, while the portion of the shoe sole structure that extends forwardly of the metatarsal arch region is free to flex and bend as needed.

According to the presently preferred form of the invention the stiffener member is not absolutely flat, but has a downward protrusion or kink at one point along its length. The purpose of the downward protrusion is to reduce the resilience of the ground-engaging portion of the elastomeric material, at that particular point along the length of the shoe sole structure.

DRAWING SUMMARY

DETAILED DESCRIPTION

Figure 1:
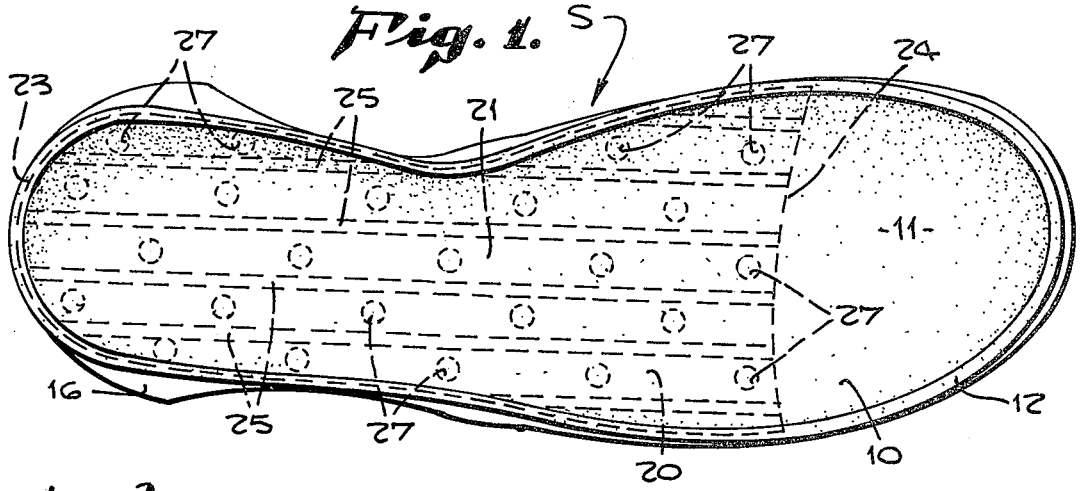
FIG. 1 is a top plan view of the shoe sole for a right shoe in accordance with the invention, showing an internal stiffener member in dotted lines.
Figure 2:
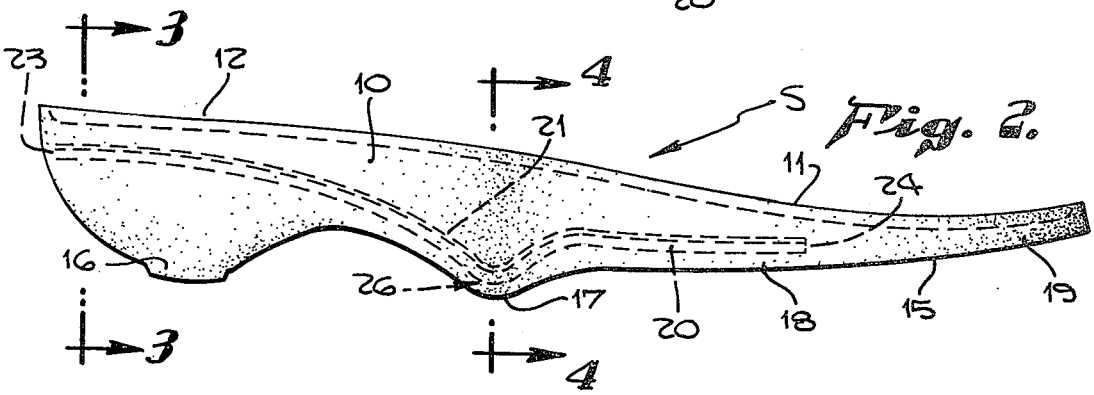
FIG. 2 is a side elevation view of the shoe sole of FIG. 1.
Figure 3:
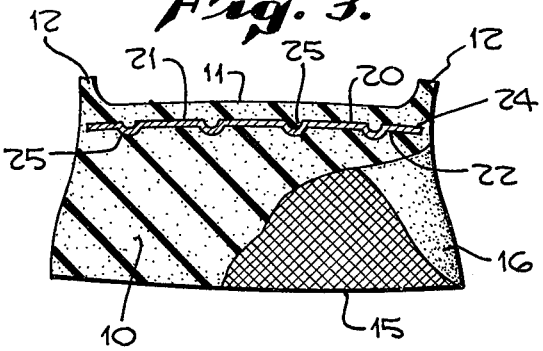
FIG. 3 is a cross-sectional view taken on line 3—3 of FIG. 2.
Figure 4:
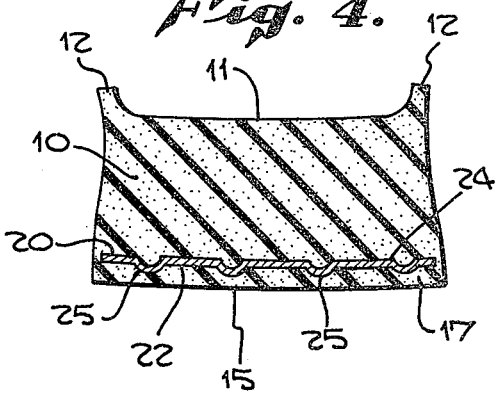
FIG. 4 is a cross-sectional view taken on line 4—4 of FIG. 2.
Figure 5:
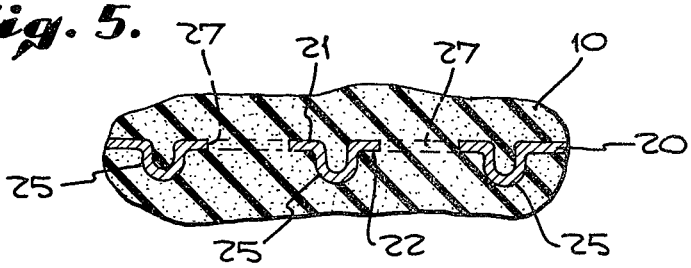
FIG. 5 is an enlarged fragmentary cross-sectional view showing details of the stiffener member.

Reference is made to FIGS. 1 through 5 of the drawing illustrating the presently preferred form of the invention.

The complete shoe sole structure S includes a solid mass of elastomeric material 10 and a metallic stiffener member 20. The elastomeric material may, for example, be soft rubber. The stiffener member may, for example, be made of an aluminum alloy.

Elastomeric member 10 has a substantially flat upper surface which is adapted to have the conventional form of shoe upper secured upon it. Thus, the upper surface 11 is a foot-supporting surface, although it supports the foot indirectly, through a conventional shoe upper, rather than directly. Around the entire circumferential edge of the upper surface 11 there is an upwardly turned flange 12.

Elastomeric member 10 also has a ground-engaging bottom surface designated generally as 15. At the rearward or heel end of the sole structure S, the elastomeric member 10 provides a rounded heel 16. Near the longitudinal center of sole structure S, but slightly to the rear of that longitudinal center, elastomeric member 10 provides a central pedestal 17, the under surface of which is also rounded in the longitudinal direction. That portion of the elastomeric member which underlies the metatarsal arch portion of the shoe is especially identified by numeral 18, while the toe-supporting portion is identified by numeral 19. The central pedestal 17 is a unique structural feature disclosed in my above-identified patent.

Stiffener member 20 has the general configuration of an elongated flat plate. Its upper surface is designated by numeral 21 while its lower surface is designated by numeral 22. The rearward or heel end of stiffener member 20 is rounded at 23 as best seen in FIG. 1. Its forward end has a substantially square cut as designated by numeral 24, but being slightly dished across the width of the sole structure S. The length of stiffener member 20 is such that it extends above the heel portion 16 of the elastomeric material, above the central pedestal 17, and into the metatarsal arch region 18. It does not extend into the toe-supporting portion 19 of the shoe sole, which is therefore free to flex vertically as needed.

In the presently preferred form of the invention the stiffener member 20 has a number of troughs or corrugations 25 formed in a longitudinal direction. The purpose of these corrugations is to enhance the resistance to bending movements in a lengthwise direction. Stiffener member 20 also has a number of holes or perforations 27 formed in it. See FIGS. 1 and 5. These holes or perforations permit the elastomeric material to be case as an integral member in which that portion of the elastomeric material below the stiffener is secured to the portion above the stiffener through the openings. The elastomeric material also completely surrounds and encloses the edges of stiffener member 20.

Thus it will be seen that in accordance with the general concept of the invention a metallic stiffener member, similar to a traditional arch support, is completely encapsulated within an elastomeric member that is cast as a single body. The ground-engaging surface of the elastomeric member lies beneath the stiffener member, while the foot-supporting surface lies above it. And the toe-supporting portion of the elastomeric member extends forwardly of the stiffener member and is free to flex vertically as needed.

However, the present invention provides more than simple encapsulation of a metallic stiffener member inside an integrally cast elastomeric member. Thus, at one point along its length the stiffener member 20 has a downward protrusion or kink 26 formed in it. The purpose of the protrusion or kink is to alter the mechanical characteristics of the ground-engaging surface of the elastomeric member. Specifically, according to the presently preferred embodiment of the invention, the protrusion or kink 26 lies immediately above the central pedestal portion 17 of the elastomeric member. As a result of this arrangement, the mechanical action of central pedestal 17 is relatively stiff while the mechanical action of the rounded heel 16 is quite resilient. Comparing the thicknesses of the resilient material which lies beneath the stiffener member 20, it will be noted that the heel portion 16 is several times as thick as the central pedestal 17. These relationships are as described in my above-identified patent.

It will be understood, however, that the present invention is not restricted to having the kink or protrusion in the stiffener member located at the location of central pedestal 17. In accordance with the invention such a kink or protrusion may, if desired, be located in the heel portion of the shoe sole structure S.

What I claim is:

1. A shoe sole structure having an upper surface adapted to support the entire foot of the wearer and an under surface adapted to engage the ground, characterized by a rear pedestal extending downward beneath the heel of the shoe and a central pedestal being longitudinally rounded on its under side to provide a roller-like portion of said sole structure under surface, said rear pedestal being very resilient while said central pedestal has far less resiliency, and said sole structure being easily bendable at and forward of the metatarsal arch region but being resistant to bending rearwardly thereof; said shoe sole structure being formed from a stiffener member which extends from the heel to the metatarsal arch region and has a downward protrusion at the instep, and a solid casting of elastomeric material which surrounds and encloses said stiffening member.

2. A shoe sole structure as in claim 1 wherein said elastomeric material is soft rubber.

3. A shoe sole structure as in claim 1 wherein said stiffener member is in the form of a generally flat metal plate having a rounded end at the heel, and having longitudinal corrugations therein to enhance its resistance to bending.

4. The shoe sole structure of claim 3 in which said stiffener member also has a downward kink at said central pedestal location.

5. A shoe sole structure comprising, in combination:

a resilient ground-engaging member adapted to extend the full length and width of a shoe;

said member having a downwardly depending heel portion having a vertical thickness of at least one inch, the under surface of said heel portion being curved in a longitudinal direction to conform approximately to the arch of a circle having a radius of curvature of about one to two inches;

said ground-engaging member also having a transverse protrusion extending downwardly slightly rearwardly of its longitudinal center to form a pedestal, the under surface of said pedestal extending below a plane defined by the under surface of said heel portion and the undersurface of the metatarsal arch portion of said ground-engaging member;

a stiffener member which covers said heel portion and said pedestal and extends to the metatarsal arch portion, said stiffener member having a downward protrusion at said pedestal; and said ground-engaging member being integrally cast of an elastomeric material so as to fully surround and enclose said stiffener member and provide an elongated foot-supporting surface extending from heel to toe.

6. A shoe sole structure as in claim 5 wherein said elastomeric material is soft rubber.

7. A shoe sole structure as in claim 5 wherein said stiffener member is in the form of a generally flat metal plate having a rounded end at the heel, and having longitudinal corrugations therein to enhance its resistance to bending, said stiffener member having a downward kink at said pedestal location.

8. A shoe sole structure comprising, in combination:

a resilient ground-engaging member adapted to extend the full width of a shoe;

said member having a downwardly depending heel portion having a vertical thickness of at least about one inch, the under surface of said heel portion being curved in a longitudinal direction to conform approximately to the arc of a circle;

said ground-engaging member also being convexly downwardly curved slightly rearwardly of its longitudinal center to form a central pedestal, the under surface of said central pedestal extending below a plane defined by the under surfaces of said heel portion and of the metatarsal arch portion of said ground-engaging member; a stiffener member which extends from the heel portion to the metatarsal portion of said ground-engaging member, and having a downward protrusion at the location of said central pedestal; and said ground-engaging member being cast from an elastomeric material so as to surround and enclose said stiffener member and provide an elongated foot-supporting surface extending from heel to toe.

9. A shoe sole structure as in claim 8 wherein the thickness of said elastomeric material which extends beneath said stiffener member at the heel location is several times its thickness at the central pedestal.

10. A shoe sole structure comprising, in combination; a stiffener member having generally the form of a flat plate extending from heel to metatarsal arch region, said plate having a plurality of perforations therein; and a solid mass of elastomeric material cast about said stiffener member so as to fully surround and enclose it and fill said perforations, said elastomeric material providing a ground-engaging surface beneath said stiffener member, a foot-supporting surface above said stiffener member, and extending forwardly of said stiffener member to provide a toe-supporting portion;

wherein said stiffener member has a downward protrusion at one point along its length, for reducing the resilience of ground support at that point.

11. A shoe sole structure as claimed in claim 10 wherein said downward protrusion is located slightly rearwardly of the longitudinal center of said shoe sole structure.

* * * * *